US005142193A

United States Patent [19]

Chang et al.

[11] Patent Number: 5,142,193

[45] Date of Patent: Aug. 25, 1992

[54] PHOTONIC CATHODE RAY TUBE

[75] Inventors: James Chang; James J. Fanning, both of Colorado Springs, Colo.

[73] Assignee: Kaman Sciences Corporation, Colorado Springs, Colo.

[21] Appl. No.: 546,578

[22] Filed: Jun. 29, 1990

Related U.S. Application Data

[63] Continuation-in-part of Ser. No. 362,238, Jun. 6, 1989, abandoned.

[51] Int. Cl.[5] ..... H01J 40/06

[52] U.S. Cl. ..... 313/542; 313/372; 313/384; 313/529; 313/544; 313/524; 250/213 VT

[58] Field of Search ..... 313/372, 542, 384, 525; 250/213 VT; 358/217

[56] References Cited

U.S. PATENT DOCUMENTS

| | | | |
|---|---|---|---|
| 4,243,878 | 1/1981 | Kalibjian | 250/213 VT |
| 4,445,132 | 5/1984 | Ichikawa et al. | 357/32 |
| 4,460,831 | 8/1984 | Oettinger et al. | 250/492.2 |
| 4,554,485 | 11/1985 | Yamada | 315/169.3 |
| 4,563,614 | 1/1986 | Howorth | 313/524 |
| 4,574,216 | 3/1986 | Hoeberechts et al. | 313/444 |
| 4,651,052 | 3/1987 | Hoeberechts | 313/446 |
| 4,712,001 | 12/1987 | d'Humieres et al. | 313/525 |
| 4,733,129 | 3/1988 | Kinoshita et al. | 313/542 |
| 4,783,139 | 11/1988 | Tsuchiya | 313/475 |
| 4,794,430 | 12/1988 | Whittaker et al. | 356/252 |
| 4,797,747 | 1/1989 | Takiguchi et al. | 358/217 |
| 4,820,927 | 4/1989 | Langner et al. | 250/492.2 |
| 4,875,093 | 10/1989 | Koishi et al. | 313/542 |

*Primary Examiner*—Donald J. Yusko
*Assistant Examiner*—Diab Hamadi
*Attorney, Agent, or Firm*—Fishman, Dionne & Cantor

[57] ABSTRACT

Apparatus for high speed analog data recording utilizing a new tube design (referred to herein as a photonic cathode ray tube) is presented. The photonic cathode ray tube includes a flat photocathode, a small aperture electron lensing system, a set of deflection plates and a phosphor screen.

31 Claims, 2 Drawing Sheets

PHOTONIC CATHODE RAY TUBE

BACKGROUND OF THE INVENTION

This invention relates generally to an apparatus for high speed analog data recording having high resolution, linearity and low distortion. More particularly, this invention relates to a photonic cathode ray tube comprising a flat photocathode, a small aperture electron lensing system, a set of deflection plates and a phosphor screen.

It is well known that conventional oscilloscopes based on the cathode ray tube (CRT) have great difficulty in achieving multi-GHz bandwidth Performance. As a result, multi-GHz oscilloscopes are very costly, and some may approach a cost of close to $90,000 or more per channel at the present time.

An alternate technology that can provide the desired high bandwidth and low cost per channel is a photonic high speed data recording system known as the high speed multichannel data recorder (HSMCDR). The HSMCDR is based on a high speed electro-optic streak camera, and the system is described in an article by J. Chang et al entitled "Photonic Methods of High Speed Analog Data Recording", Rev. Sci. Instrum., Vol. 56, No. 10 56(10), October 1985. In the approach of the HSMCDR, many channels (up to 40) of optical analog data can be input and recorded by one streak camera. However, in order to realize this low cost or cost reduction per channel (as compared to the conventional oscilloscope) it is necessary to record all, or substantially all, of the channels simultaneously. Unfortunately, the necessity of tying forty or more channels together to achieve economy is a handicap because, often times, it is difficult to find a large number of channels that all require the same sweep rate. Moreover, should the streak camera fail at the critical time, then all forty or more channels of data would be lost.

The use of streak cameras also involves economic considerations Streak cameras are very expensive, perhaps on the order of $150,000. Because of that high cost, they are often used in multichannel form (30–40 channels) to reduce the per channel cost. However, while the use of a multichannel streak camera does reduce cost per channel, the total cost of a 30–40 channel HSMCDR may be in the range of $500,000, thus requiring a large investment to get the low per channel cost.

The technology of the streak camera per se, also suffers from several drawbacks and deficiencies. The conventional streak tube is basically a large aperture (and large field of view) optical system that has pronounced edge distortions, sweep nonlinearity and nonuniformity of photocathode response. As a result, the performance of the streak tube is rather limited and often insufficient. In order to compensate for the lack of edge definition in streak cameras, it is usual to detune the center to enhance the definition at the edges of the lens. This detuning is accomplished in the lens which is a large aperture and large field of view system located about mid-way between the photocathode and the phosphor screen.

Another problem with streak cameras is that they require relatively large photocathodes (on the order of 4–5 cm. in diameter), and such large photocathodes are very expensive. It is difficult to get a uniform coating on a large photocathode surface, so manufacturing process yields are very low, thus resulting in very high final cost.

Because the photocathode and the phosphor screen in a conventional streak camera have slightly curved configurations (to provide equal distance to all points), more desirable crystalline material cannot be used to coat the cathode (because the crystal structure is flat). This is still another drawback of these prior art systems.

SUMMARY OF THE INVENTION

The above-discussed and other problems and deficiencies of the prior art are overcome or alleviated by the novel apparatus for high speed analog data recording of the present invention. In accordance with the present invention, a new tube called a photonic cathode ray tube (PCRT) is provided which includes a small diameter flat photocathode, a small aperture electron lensing system, a set of deflection plates and a phosphor screen. In a first embodiment, a multichannel array of fiber optic elements are input directly to the photocathode, and readout apparatus is coupled to the output of the phosphor screen. In a second embodiment, an LED or a single optical fiber is used to input light to the photocathode. This second embodiment also uses two pairs of deflection plates offset from one another by 90°; and does not require the use of readout apparatus.

The photocathode is small (on the order of 0.2–1 cm. in diameter), and flat; and, it is preferably coated with a crystal material (e.g. gallium arsenide). The use of a crystal coating is possible because the photocathode is small and because it is flat; and the crystal coating is very desirable because its operating range is matched to the wavelength of many lasers now in use. The small cathode size also makes it much easier to coat uniformly, thus significantly increasing the yield of the manufacturing process and reducing the cost of the cathode.

The fiber optic elements are in a linear (preferably horizontal) array and are input about the center of the photocathode over a small distance of about 2 mm.

In a first embodiment, the lens system is a small aperture system, preferably a pinhole (on the order of 1 mm in diameter) in a positively charged disc, and the lens is located very close to the photocathode. By locating the lens close to the cathode, a more simplified lens (relative to the prior art) may be used. In a second embodiment, the electronic lens comprises a cylindrical tube lens, also of small aperture.

As will be discussed in more detail below, the photonic cathode ray tube of the present invention incorporates the best features of the prior art CRT oscilloscope and streak tube camera (without the drawbacks associated with each) to record photon analog data. Furthermore, the photonic cathode ray tube of the present invention is characterized by high resolution, linearity and low distortion; and it has a low cost per channel as well as a low overall cost.

The above-discussed and other features and advantages of the present invention will be appreciated and understood by those of ordinary skill in the art from the following detailed description and drawing.

BRIEF DESCRIPTION OF THE DRAWING

Referring now to the drawings, wherein like elements are numbered alike in the several FIGURES.

DESCRIPTION OF THE PREFERRED EMBODIMENT

Figure 1:
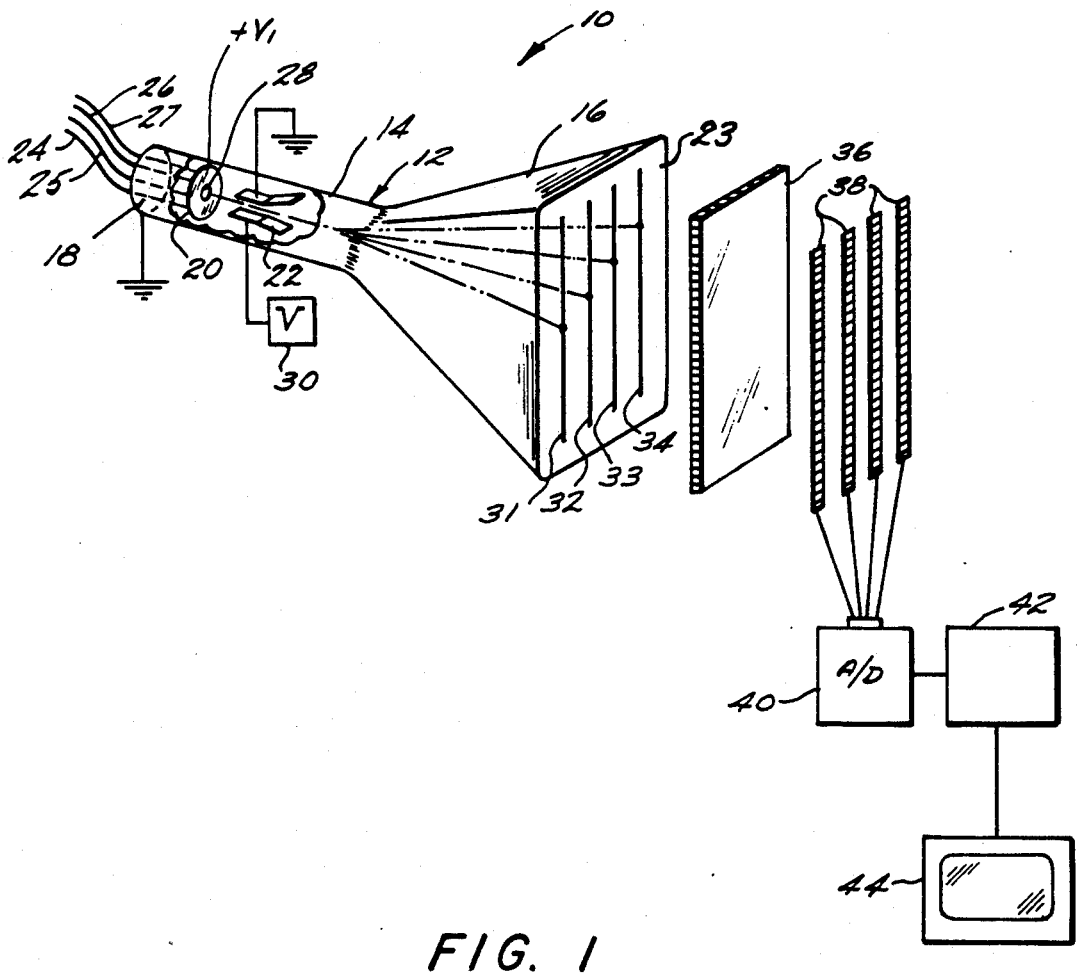
FIG. 1 is a schematic perspective of a photonic cathode ray tube in accordance with a first embodiment of the present invention.

In FIG. 1, a first embodiment of a photonic cathode ray tube (PCRT) is shown generally at 10 and includes a vacuum tube 12 having a first cylindrical section 14 of small diameter and a second frustoconical section 16 of larger diverging diameter. The interior of tube 12 comprises, sequentially from section 14 to section 16, a photocathode 18, an electron focussing lens 20, a pair of opposed deflection plates 22 and a phosphor screen 23.

The PCRT of this invention may be used in one embodiment with an optic input to photocathode 18. For example, an array of fiber optic elements may be input directly to photocathode 18. In the illustrated embodiment shown in FIG. 1, four optical fibers 24, 25, 26 and 27 are shown. It will be appreciated that any desired number of fiber optic elements may be provided as input channels to photocathode 18, subject, however, to both space limitations (the small photocathode diameter) and to economic considerations (i.e., the desire to keep down the overall cost of the system). Preferably, all fiber inputs will be closely spaced over a short span about the center axis of photocathode 18 in a horizontal input array. The horizontal array of fibers should preferably be equally spaced on each side of the photocathode center axis.

Photocathode 18 is of relatively small size (e.g. about 0.2 to about 1 cm diameter) and is preferably flat. This combination of small size (relative to larger prior art cathodes of 4 to 5 cm diameter) and flatness (relative to prior art streak camera cathodes which are slightly curved) permits easy and uniform coating of photocathode 18. In addition, the flat surface of photocathode 18 permits coating with certain desirable crystalline materials such as gallium arsenide The use of a crystalline coating is desirable because its operating range is matched to the wavelength of many lasers now in use. Photocathode 18 is electrically grounded.

In a presently contemplated preferred embodiment of the invention, the photocathode is 3 mm in diameter and an array of four optical fibers (i.e. channels) is spaced in a horizontal array over a span of 2 mm about the central axis of the cathode.

Figure 3:
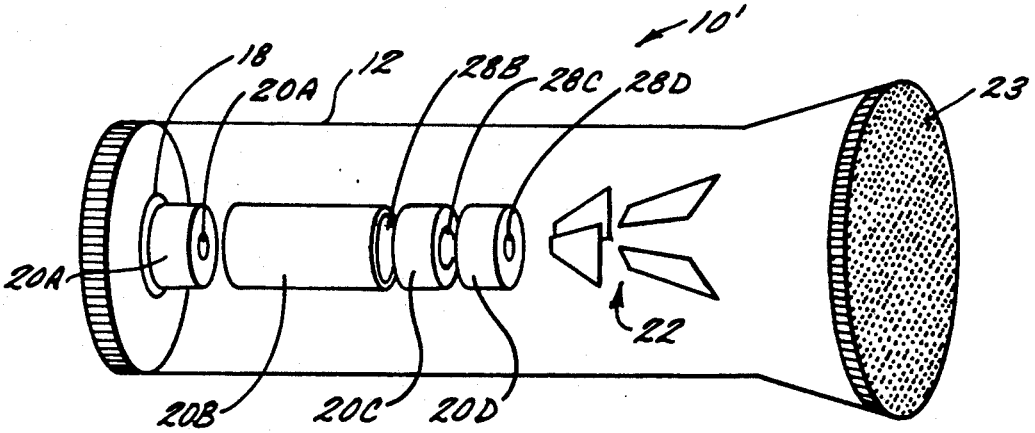
FIG. 3 is a perspective view of an embodiment of a lens suitable for use in the photonic cathode ray tube of the present invention comprising an assembly of apertures and tubes.

Unlike the relatively complicated, larger aperture streak camera lens of the prior art, which were generally located mid-way between the photocathode and the phosphor tube, lens 20 in PCRT 10 is a small aperture lens, on the order of 1 mm in diameter is of simple design and is positioned very close to photocathode 18 (preferably a distance of about 1 mm). By locating lens 20 close to photocathode 18, sharper focus may be obtained along with better resolution. Lens 20 comprises an assembly of apertures and tubes of various designs depending on the desired resolution and streak length on the phosphor screen. This assembly of apertures and tubes is depicted in FIG. 3 as positively charged annular elements 20A, 20B, 20C and having apertures 28A, 28B, 28C and 28D respectively therethrough.

The PCRT 10 of the present invention requires only a single set of opposed deflection plates 22 since deflection of electrons takes place along only one axis. As schematically shown in FIG. 1, a known sweep ramp voltage pulse is applied to the other deflection plates as will be discussed in more detail below.

The analog output of PCRT 10 is shown by the four vertical lines 31, 32, 33 and 34 in FIG. 1 corresponding, respectively to fiber inputs 24, 25, 26 and 27. Any number of known devices may be used to convert this analog readout to a digital readout. An example is shown in FIG. 1 and comprises a fiber optic face plate 36, an array 38 of four linear photodiode readout elements, an analog to digital converter 40 connected to receive the outputs from each of the linear photodiode elements, a computer 42 connected to A/D converter 40 and a display and/or recorder 44 connected to computer 42. All of the aforementioned components making up the output digital readout system are well known to one of ordinary skill in the art.

The PCRT of the present invention operates as follows:

Optical signals from fiber optic elements 24–27 and delivered to photocathode 18 and are converted into photoelectrons in a known manner. These photoelectrons are then emitted from photocathode 18 and are accelerated through electron focussing lens 20 onto phosphor screen 23. The sweep ramp voltage pulse device 30, synchronized with the arrival of the signal to deflect the photoelectrons vertically along phosphor screen 23. The signals are dispersed in time and appear as streaks 31, 32, 33 and 34 on phosphor screen 23. It will be appreciated that the intensity variations of the streaks correspond to the intensity of the signals originally carried in the optical fiber elements. Fiber optic face plate 36 will have four channels, one communicating with and corresponding to each of the display lines 31–34 on phosphor screen 23. Likewise, readout array 38 will have four linear photodiode elements, corresponding to and communicating with one each of the channels on face plate 36.

The analog output in the form of streaks 31, 32, 33, and 34 is then passed through the output digital readout system as follows. The optical fiber face plate 36 couples the streaks 31, 32, 33 and 34 on phosphor screen 23 to each of the respective photodiode readout elements in array 38. The photodiode readouts from linear photodiode array 38 are converted to digital form by A/D converter 40 and stored in computer 42 for reduction and eventual display on screen 44. As mentioned, a number of suitable and known devices may be used for digital readout purposes, the fiber optic face plate and linear photodiode array described above serving only as an example.

The PCRT of the present invention has many features and advantages relative to prior art cathode ray tubes and streak tubes. Some of the more important features of the present invention are summarized as follows: 1. The PCRT is a simplification of the CRT and the streak camera which retains the best features (including high performance) of the two; but may be constructed at a far lower cost than either. 2. The electron lens is very close to the photocathode and this makes it a small aperture imaging system which has high resolution, linearity and low distortion. 3. In view of the low distortion, the PCRT offers a long record. 4. As in a streak camera, deflection solely along a single axis eliminates one set of deflection plates when compared to a conventional CRT. 5. The small size of the PCRT allows high density packing and highly efficient use of available space. 6. The PCRT offers very high writing speed with low distortion which can lead to subpicosecond resolution. 7. The PCRT does not utilize a thermoionic electron gun thereby reducing the heat load on the system.

The photonic cathode ray tube of the present invention is well suited for a myriad of important and demanding applications. For example, the PCRT may be used to record analog photonic data directly, or electrical data through LED's or laser diode transmitters, at very high bandwidth (as high as 10 GHz) and linearity. The PCRT may also be used to record digital photonic data from multi-GHz fiber optic transmission systems and serve as a demultiplexer from high Giga rate to 100M bit rate. Still another application for the PCRT is as a counter for high energy particle physics experiments where the PCRT combines the functions of a photomultiplier tube and a digital counter.

Figure 2:
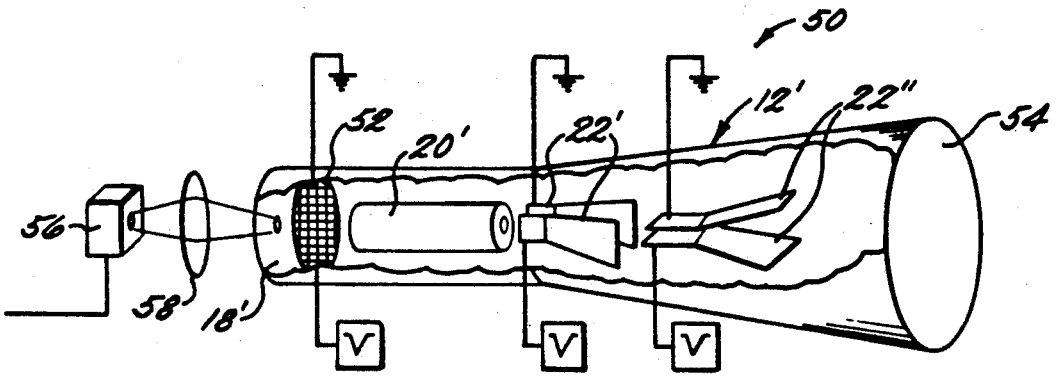
FIG. 2 is a schematic view of a photonic cathode ray tube in accordance with a second embodiment of the present invention.

Referring now to FIG. 2, a second embodiment of a photonic cathode ray tube in accordance with the present invention is shown generally at 50. In PCRT 50, the electron gun of prior art CRTs has been replaced with a photocathode 18' as in the FIG. 1 embodiment. In addition, the FIG. 2 embodiment utilizes a low cost LED to stimulate, either directly or by coupling through a fiber, the photocathode to produce the needed electron beam. Significantly, the FIG. 2 embodiment will operate at ambient temperature and will not generate excessive heat during operation (as is well known in prior art CRT designs).

In general, PCRT 50 includes two elements, a vacuum tube 12' and LED 56. Vacuum tube 12' contains the photocathode 18', an optional control grid 52, an electronic lens 20', two sets of deflection plates 22' and 22'' (which are orthogonal to each other) and a phosphor screen 54. Optically coupled to photocathode 18' is a light source which preferably comprises a low cost LED 56. LED 56 is coupled to photocathode 18' either by an optical lens 58 or by fiber optics. In either case, the LED is external to vacuum tube 12'.

As light incidents on the photocathode 18', photoelectrons are emitted and they are accelerated through the electron lens system 20' to form a spot on the phosphor screen. The spot on the phosphor screen is rastered using the orthogonal sets of deflection plates 22', 22'' to produced a desired display format. It will be appreciated that there are at least two ways to modulate the electron beam to form images on phosphor screen 54. One method is to impress the modulation signal on the electronic beam in the vacuum tube such as by inputting a modulation voltage to the grid near the photocathode. A second method is to modulate the light incident on the photocathode by directly modulating the LED. It is believed that the second method is the preferred mode of operation because it removes the need for a control grid 52 near the photocathode and therefore permits higher modulation frequencies.

The embodiment of the present invention set forth in FIG. 2 provides many features and advantages relative to prior art cathode ray tubes. In particular, the energy consuming hot filament present in an electron gun of prior art cathode ray tubes is not present in the FIG. 2 embodiment (or the FIG. 1 embodiment). In addition, the electron emission source size can be as small as the focal spot of light from the LED. The benefits offered by PCRT 50 are many. For example, the vacuum tube 12' has a long life (as long as the vacuum is maintained in the tube, it should remain functional), particularly because of its operation at ambient temperatures. In addition, tube 12' has a small electron emission spot and therefore high resolution. Also, PCRT 50 has a low power requirement and a more efficient method to modulate the electron beam for display purposes. In fact, the power requirement for the PCRT 50 is reduced from about 25 watts for the electron gun of the prior art to a few milliwatts for the LED driven PCRT 50. Modulation of PCRT 50 can now be done with the LED i.e. by controlling the light emitted from the LED and incident on the photocathode. The LED is a low cost solid state device with a low capacitance which makes it easy to modulate and to modulate at higher speeds. Since the LED is external to the tube, it can be easily replaced should it become necessary. The replacement of the LED is certainly a low cost operation as compared to replacing an entire CRT as is now required in prior art devices.

It will be appreciated that PCRT 50 can utilize one or more LED inputs. Each LED may require its own set of electronic lenses and deflection plates for independent focussing and rastering. In other words, the PCRT 50 can be used to build a monochrome gray scale display tube, a three-colored tube, as well as any other specialty display tube that requires multiple electron beams.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A photonic cathode ray tube comprising:

vacuum tube means having opposed first and second ends;

photocathode means in said tube means at said first end of said tube means;

phosphor screen means in said tube means at said second end of said tube means;

electron focussing lens means disposed in said tube means in close proximity to said photocathode, said lens means including a small aperture therethrough, said aperture having a diameter of about 1 mm; and deflection plate means in said tube means, said deflection plate means being between said lens means and said second end of said tube means.

2. The device of claim 1 wherein:

said electron focussing lens means comprises an assembly of apertures and tubes.

3. The device of claim 1 wherein:

said photocathode means is substantially flat and has a diameter of from 0.2 to 1 cm.

4. The device of claim 1 wherein:

said electron focussing means comprises a cylindrical tube.

5. The device of claim 1 wherein:

said photocathode means and said lens means are separated by a distance of about 1 mm.

6. The device of claim 1 wherein:

said photocathode means is substantially flat.

7. The device of claim 6 wherein:

said photocathode means is coated with a crystalline material.

8. The device of claim 7 wherein:

said crystalline material comprises gallium arsenide.

9. The device of claim 1 including:

light emitting diode (LED) means in input optical communication with said photocathode means.

10. The device of claim 9 wherein said deflection plate means comprises:

a first pair of deflection plates; and a second pair of deflection plates orthogonal to said first pair of deflection plates.

11. The device of claim 9 wherein:

said electron focussing lens means comprises a cylindrical tube.

12. The device of claim 9 including:

control grid means between said photocathode means and said electron focussing lens means for modulating an electron beam output from said photocathode means.

13. The device of claim 9 including:

a lens between said LED means and said photocathode means for delivering optical signals from said LED means to said photocathode means.

14. The device of claim 1 including:

at least one fiber optic element in input communication with said photocathode means.

15. The device of claim 14 including:

an array of fiber optic elements in input communication with said photocathode means.

16. The device of claim 15 wherein:

said array of fiber optic elements is evenly disposed about a central axis of said photocathode means.

17. The device of claim 15 wherein:

said array of fiber optic elements is positioned along a horizontal line.

18. The device of claim 17 wherein:

said array of fiber optic elements is evenly disposed about a central axis of said photocathode means.

19. The device of claim 17 wherein:

the width of said horizontal array is equal to or less than about 2 mm.

20. A photonic cathode ray tube comprising:

vacuum tube means having opposed first and second ends;

photocathode means in said tube means at said first end of said tube means;

phosphor screen means in said tube means at said second end of said tube means;

electron focussing lens means disposed in said tube means in close proximity to said photocathode, said photocathode means and said lens means being separated by a distance of about 1 mm, said lens means including a small aperture lens therethrough; and deflection plate means in said tube means, said deflection plate means being between said lens means and said second end of said tube means.

21. A photonic cathode ray tube comprising:

vacuum tube means having opposed first and second ends;

photocathode means in said tube means at said first end of said tube means;

phosphor screen means in said tube means at said second end of said tube means;

electron focussing lens means disposed in said tube means in close proximity to said photocathode, said photocathode means and said lens means being separated by a distance of about 1 mm, said lens means being a small aperture lens;

deflection plate means in said tube means, said deflection plate means being between said lens means and said second end of said tube means; and at least one fiber optic element in input communication with said photocathode means.

22. The device of claim 21 including:

an array of fiber optic elements in input communication with said photocathode means.

23. The device of claim 22 wherein:

said array of fiber optic elements is evenly disposed about a central axis of said photocathode means.

24. The device of claim 22 wherein:

said array of fiber optic elements is positioned along a horizontal line.

25. The device of claim 24 wherein:

said array of fiber optic elements is evenly disposed about a central axis of said photocathode means.

26. The device of claim 24 wherein:

the width of said horizontal array is equal to or less than about 2 mm.

27. A photonic cathode ray tube comprising:

vacuum tube means having opposed first and second ends;

photocathode means in said tube means at said first end of said tube means, said photocathode means being substantially flat;

phosphor screen means in said tube means at said second end of said tube means;

electron focussing lens means disposed in said tube means in close proximity to said photocathode, said photocathode means and said lens means being separated by a distance of about 1 mm, said lens means being a small aperture lens; and deflection plate means in said tube means, said deflection plate means being between said lens means and said second end of said tube means.

28. The device of claim 27 wherein:

said photocathode means has a diameter of from 0.2 to 1 cm.

29. The device of claim 27 wherein:

said photocathode means is coated with a crystalline material.

30. The device of claim 29 wherein:

said crystalline material comprises gallium arsenide.

31. A photonic cathode ray tube comprising:

vacuum tube means having opposed first and second ends;

photocathode means in said tube means at said first end of said tube means;

phosphor screen means in said tube means at said second end of said tube means;

electron focussing lens means disposed in said tube means in close proximity to said photocathode, said photocathode means and said lens means being separated by a distance of about 1 mm, said lens means being a small aperture lens and comprising an assembly of apertures and tubes; and deflection plate means in said tube means, said deflection plate means being between said lens means and said second end of said tube means.

* * * * *